United States Patent [19]

Hallett et al.

[11] 4,151,497

[45] Apr. 24, 1979

[54] ARC-RESISTANT DEFLECTION YOKE

[75] Inventors: Joseph L. Hallett; Martin Fischman, both of Seneca Falls, N.Y.

[73] Assignee: GTE Sylvania Incorporated, Stamford, Conn.

[21] Appl. No.: 839,987

[22] Filed: Oct. 6, 1977

Related U.S. Application Data

[63] Continuation of Ser. No. 673,693, Apr. 5, 1976, abandoned.

[51] Int. Cl.[2] ..... H01J 29/66

[52] U.S. Cl. ..... 335/213

[58] Field of Search ..... 29/605; 335/210, 213

[56] References Cited

U.S. PATENT DOCUMENTS 3,622,927 11/1971 Washburn ..... 335/213 X 3,631,902 1/1972 Torsch ..... 29/605 X 3,854,108 12/1974 Horie et al. ..... 335/210

*Primary Examiner*—A. D. Pellinen

*Attorney, Agent, or Firm*—Thomas H. Buffton

[57] ABSTRACT

An arc-resistant deflection yoke for a cathode ray tube deflection system includes a core of magnetic material having a pair of axes with first and second deflection windings toroid-wound in mirror image relationship on opposite sides of one axis and third and fourth deflection windings toroid-wound in a continuous-wound relationship on opposite sides of the other axis. The arc-resistant deflection yoke is fabricated by a process of selecting a core, toroid-wrapping first and second windings on opposite sides of one axis in mirror image of one another and toroid-wrapping third and fourth windings on opposite sides of an opposite axis in continuous-wound relationship.

5 Claims, 5 Drawing Figures

ARC-RESISTANT DEFLECTION YOKE

This application is a continuation of an application bearing U.S. Ser. No. 673,693, filed Apr. 5, 1976, now abandoned.

BACKGROUND OF THE INVENTION

This invention relates to an arc-resistant deflection yoke and the fabrication thereof and more particularly to toroid-wound deflection yokes suitable for use in the cathode ray tube deflection system of a television receiver wherein the yoke is resistant to transmission of arcs which may occur in the cathode ray tube.

One of the problems associated with cathode ray tubes, and especially cathode ray tubes employed in present-day television receivers wherein ever higher high voltage potentials are being utilized, is internal arcing. It has been found that internal arcs in cathode ray tubes are often of a magnitude of several hundred AMPS. However, such arcs usually are of very short duration such as about 0.1 micro-seconds for example.

Also, it has been found that internal arcing in a cathode ray tube causes a relatively large pulse current flow in the internal aquadag coating deposited on the inner surface of the funnel portion of the cathode ray tube. In other words, the aquadag coating on the funnel portion of the cathode ray tube is surrounded by a deflection yoke externally associated with the cathode ray tube. Thus, the aquadag coating or the arc path behaves as a large single turn primary winding having a large pulse current flow which passes through the center of the associated deflection yoke. As a result, a relatively large pulse potential tends to be induced into the windings of the deflection yoke and, in turn, undesirably applied to circuitry associated with the windings. As a result, component burn out problems are frequently encountered.

As set forth in the prior art, specifically U.S. Pat. No. 3,631,902 issued on Jan. 4, 1972 and assigned to the Assignee of the present application, a minimum of electrostatic and magnetic cross-induction is achieved with a deflection yoke wherein the horizontal and vertical deflection windings are in a mirror image relationship. In such a configuration, an introduced pulse potential is quickly transmitted through the windings since there is a minimum of inductive and capacitive losses. In other words, the mirror-image windings act as a very efficient transformer for quickly conveying an applied energy pulse therethrough.

Although the above-described deflection yokes having mirror-image windings have been and still are used in many cathode ray tube deflection systems with excellent results, it has been found that there are occasions and apparatus which does not lend itself to such a deflection yoke configuration. For example, one known form of apparatus included a cathode ray tube experiencing internal arcing which appeared in the aquadag coating or arcing path as a very high pulse current having a very short duration. In turn, this very high and fast pulse current traveled rapidly through the mirror-image windings of the deflection yoke and arced to a high voltage source providing a path for high voltage through the deflection windings to circuitry associated therewith and resulted in component failure in the associated circuitry.

OBJECTS AND SUMMARY OF THE INVENTION

An object of the present invention is to provide an enhanced television receiver employing a cathode ray tube deflection system. Another object of the invention is to improve the cathode ray tube deflection system of a television receiver. Still another object of the invention is to provide a deflection yoke having a winding configuration formed to inhibit circuitry damage due to internal arcing in a cathode ray tube. A further object of the invention is to provide an enhanced technique for fabricating a deflection yoke resistant to transmission of arcs occurring in a cathode ray tube.

These and other objects, advantages and capabilities are achieved in one aspect of the invention by a deflection yoke having a core of magnetic material with horizontal and vertical axis, first and second deflection windings toroid-wound on opposite sides of one of the axes and advancing in opposite directions to provide a mirror-image relationship, and third and fourth deflection windings toroid-wound on opposite sides of the other one of the axes and advancing in the same direction to provide a continuous-wound relationship.

In another aspect of the invention, a deflection yoke fabricating process includes the steps of selecting a core of magnetic material having horizontal and vertical axes, toroid-winding first and second deflection windings on opposite sides of one axis and advancing in opposite directions, and toroid-winding third and fourth deflection windings on opposite sides of the other one of the axes and advancing in the same direction.

PREFERRED EMBODIMENT OF THE INVENTION

For a better understanding of the present invention, together with other and further objects, advantages and capabilities thereof, reference is made to the following disclosure and appended claims in conjunction with the accompanying drawings.

Figure 1:
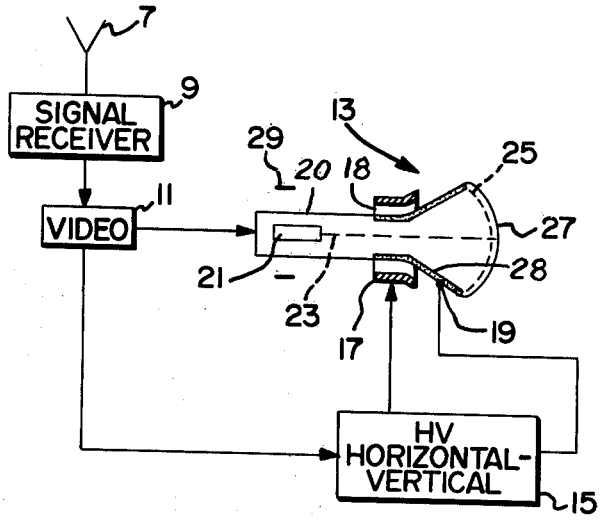
FIG. 1 is a cross-sectional elevation of a cathode ray tube and associated toroidal-wound deflection yoke.

Referring to FIG. 1 of the drawings, a typical television receiver includes an antenna 7 for intercepting transmitted television signals and applying these signals to a signal receiver 9. The signal receiver 9 includes the usual RF and IF amplifier, mixer, and detector stages and provides an output signal which is applied to a video signal channel 11.

The video signal channel 11 provides an output signal which is coupled to and controls the luminance response of a cathode ray tube 13. Another output signal from the video signal channel 11 is applied to a high voltage and horizontal and vertical deflection stage 15. In turn, horizontal and vertical deflection potentials are applied to a deflection yoke 17 having a substantially circular-shaped core member 18 formed to telescope over the neck portion 20 of the cathode ray tube 13 while a high voltage potential is applied to a high voltage terminal 19 formed on the cathode ray tube 13.

The cathode ray tube 13 includes a plurality of electron guns 21 whose activation cause a flow of electrons or an electron beam 23 to pass through an aperture mask 25 and strike the viewing screen 27. The cathode ray tube 13 also has a layer of electrically conductive material 28, such as aquadag, for example, disposed on the inner surface thereof for dissipating any electrical charge accumulated at the aperture mask 25. Moreover, convergence apparatus 29 is also associated with the cathode ray tube 13 and in conjunction with the deflection yoke 17 serves to control the angle of impingement of the electron beams 23 and viewing screen 27.

In order to set forth the arc-resistant capabilities of the present invention, it should first be noted that the above-mentioned layer of electrically conductive material coating, 28 of FIG. 1, may be envisioned as a single turn primary winding of a transformer having a very large pulse current flow therethrough whenever an arc occurs within the cathode ray tube 13. Moreover, this pulse current flow exists for the duration of the arc and produces voltages in the horizontal and vertical windings of the deflection yoke 17.

In order to provide a basis for judgment of the resultant effect of such undesired arcing, it may be noted that arcs of of the magnitude of about three-thousand (3000) volts having a duration of about 0.1-seconds are not at all uncommon in present-day cathode ray tubes. Such arcing provides pulse currents in the range of about 200-amperes and, assuming a turns ratio of about 100:1, may provide a pulse current of about 2-amperes at the junction of a pair of vertical deflection windings. Moreover, this 2-ampere current flowing through a one-thousand ohm resistor provides an arcing potential in the range of about 2000-volts.

Figure 2:
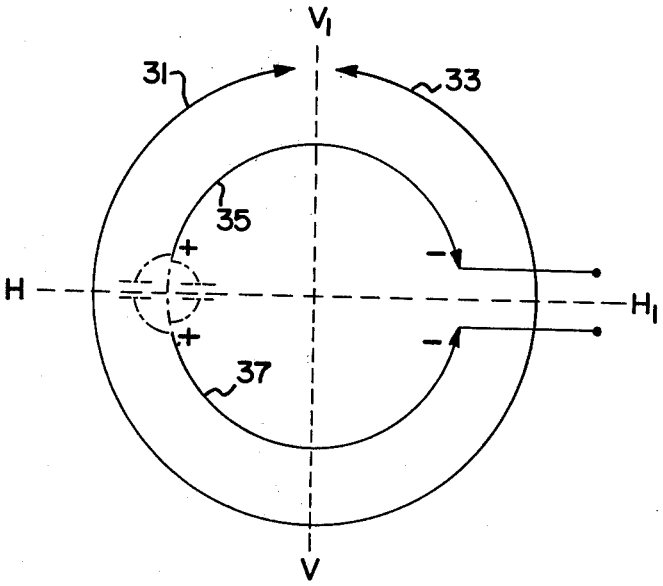
Fig. 2 PRIOR ART
FIG. 2 is a diagrammatic illustration of a prior art type of deflection yoke employing a mirror-image winding configuration.

Referring to the prior art, as illustrated by FIG. 2, first and second horizontal deflection windings 31 and 33 are toroid-wound in mirror image relationship on opposite sides of a vertical axis V—V of a deflection yoke. First and second vertical deflection windings 35 and 37 are toroid wound in mirror-image relationship on opposite sides of a horizontal axis H—H of the deflection yoke and overlapping the first and second horizontal deflection windings 31 and 33. Moreover, a pulse current resulting from an arc within the cathode ray tube 13 would exhibit substantially the same polarity in each of the first and second vertical deflection windings 35 and 37 as indicated by the positive and negative polarity signs adjacent the windings of FIG. 2.

Figure 3:
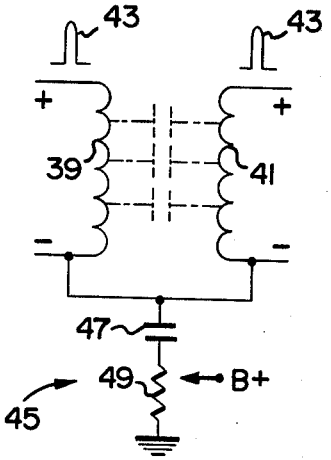
Fig. 3 PRIOR ART
FIG. 3 is a transformer configuration utilized in explaining the deflection yoke of FIG. 2.

In order to illustrate the operation of the prior art embodiment of FIG. 2, FIG. 3 diagrammatically sets forth a pair of windings 39 and 41 in a transformer-like configuration and representative of the first and second vertical deflection windings 35 and 37 of FIG. 2. With the windings 39 and 41 having a polarity the same as the polarity of the vertical windings 35 and 37, referenced in FIG. 2, a pulse signal 43 applied thereto would be transmitted very rapidly to a load circuit 45 such as the series connected capacitor 47 and resistor 49.

More importantly, the application of a pulse signal 43 having the same polarity to both windings 39 and 41 causes a minimum of potential differential and a minimum of displacement current flow therebetween by way of the inherent capacitive coupling of the windings. Thus, the windings 39 and 41 act as what may best be described as a very good energy transformer and the pulse energy is rapidly transferred to the load circuit 45. Moreover, the large amount of energy in the load circuit 45 is undesirably conducive to arcing to adjacent components such as a B+ supply for example. Thereupon, the potential from the B+ supply will be applied to the deflection windings 39 and 41 and eventually to the deflection circuitry coupled thereto whereupon burn out of the components frequently occurs.

Figure 4:
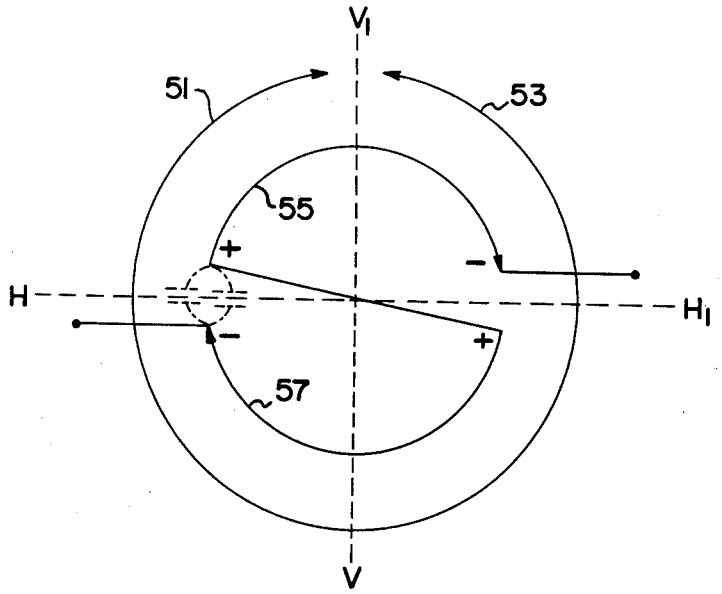
FIG. 4 is a diagrammatic illustration of a preferred embodiment of the invention employing a combined mirror-image and continuous wound configuration.

However, a preferred embodiment of the present disclosure is diagrammatically illustrated in FIG. 4. Therein, first and second horizontal deflection windings 51 and 53 are toroid-wound in mirror image relationship on opposite sides of a vertical axis V—V′ of the deflection yoke. First and second vertical deflection windings 55 and 57 are toroid wound in a continuous-wound configuration and disposed on opposite sides of a horizontal axis of the deflection yoke and overlapping the first and second horizontal deflection windings 51 and 53. In other words, the continuous-wound configuration means that the wire is continuously advanced in one direction for both of the first and second vertical deflection windings 55 and 57. Moreover, an arc resulting pulse current will result in an opposite polarity potential in each of the windings 55 and 57 as illustrated by the positive and negative polarity signs.

Figure 5:
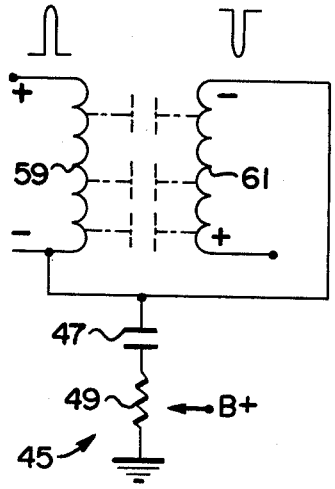
FIG. 5 is a transformer configuration utilized in explaining the deflection yoke of FIG. 3.

To again illustrate a principle, FIG. 5 provides a pair of transformer windings 59 and 61 representative of the first and second vertical deflection windings 55 and 57 of FIG. 4. Since the windings and polarities are opposite, as compared with FIG. 3, the potential between windings will be a maximum rather than a minimum. This increased potential differential will tend to increase current flow therebetween by way of the inherent mutual winding capacity. As a result, the pulse current appearing at a load circuit 45 will be of a reduced magnitude as compared with the pulse potential of FIG. 3 for the same time period.

More specifically, the combination of mirror image wound and continuous wound deflection windings tends to provide a less efficient transformer as compared with mirror image wound deflection windings. Thus, the pulse potential appearing at the load circuit within the same arcing period is of much less magnitude when a continuous wound deflection winding is employed as compared with all mirror image windings. As a result, the potential developed at the load circuit is of a smaller magnitude and the tendency for arcing to adjacent components to occur is reduced.

Thus, there has been provided a unique deflection yoke for a cathode ray tube wherein the deflection yoke has increased resistance to the transfer of arcing which occurs within the cathode ray tube. The yoke configuration is wound in a manner such that the tendency for the deflection yoke to arc to other components and result in the undesired application of potentials causing burn-out of circuitry coupled to the deflection yoke is greatly reduced.

While there has been shown and described what is at present considered the preferred embodiment of the invention, it will be obvious to those skilled in the art that various changes and modifications may be made therein without departing from the invention as defined by the appended claims.

What is claimed is:

1. In a cathode ray tube deflection system for a color television receiver, an arc resistant deflection yoke comprising:

a substantially circular core of magnetic material having horizontal and vertical axes;

first and second deflection windings toroidally wrapped on said core on opposite sides of one of said horizontal and vertical axes with each of said windings having wire turns advancing in opposite directions in a mirror image relationship; and third and fourth deflection windings toroidally wrapped on said core on opposite sides of the other one of said horizontal and vertical axes and overlapping said first and second deflection windings respectively providing capacitive coupling therebetween, each of said third and fourth deflection windings having wire turns advancing in the same direction to provide a continuous-wound relationship with respect to said mirror image relationship of said first and second deflection windings whereby said overlapping mirror image wound and continuous wound deflection windings provide a less efficient transformer and less efficient transfer system for undesired arc signals as compared with mirror image wound, mirror image wound deflection windings.

2. The arc-resistant deflection yoke of claim 1 wherein said first and second deflection windings are vertical deflection windings disposed on opposite sides of said horizontal axis.

3. The arc-resistant deflection yoke of claim 1 wherein said first and second deflection windings are horizontal deflection windings disposed on opposite sides of said vertical axis.

4. The arc-resistant deflection yoke of claim 1 wherein said third and fourth deflection windings are vertical deflection windings disposed on opposite sides of said horizontal axis.

5. The arc-resistant deflection yoke of claim 1 wherein said third and fourth deflection windings are horizontal deflection windings disposed on opposite sides of said vertical axis.

* * * * *